United States Patent [19]

Collin et al.

[11] 3,932,173

[45] Jan. 13, 1976

[54] INDUCTIALLY HEATED GAS LIFT PUMP ACTION METHOD FOR MELT REDUCTION

[75] Inventors: Per Harald Collin, Falun, Sweden; Folke Karl Evald Johansson, San Remo, Italy

[73] Assignee: Allmanna Svenska Elektriska Aktiebolaget, Sweden

[22] Filed: Sept. 25, 1973

[21] Appl. No.: 400,650

[30] Foreign Application Priority Data

Sept. 27, 1972 Sweden ..... 12487/72

[52] U.S. Cl. ..... 75/93 R; 75/46; 75/61; 266/34 A

[51] Int. Cl.[2] ..... C22B 9/00

[58] Field of Search ..... 75/61, 93 R, 46; 266/34 A, 266/34 T, 34 PP, 39, 35

[56] References Cited

UNITED STATES PATENTS

| | | | |
|---|---|---|---|
| 688,557 | 10/1901 | Talbot | 75/61 X |
| 2,247,262 | 6/1941 | Uoy | 75/24 |
| 3,664,652 | 5/1972 | Spire et al. | 266/34 PP X |
| 3,792,848 | 2/1974 | Ostberg | 266/34 T X |
| 3,820,767 | 6/1974 | Metz | 266/34 T |

FOREIGN PATENTS OR APPLICATIONS

| | | | |
|---|---|---|---|
| 215,243 | 4/1968 | U.S.S.R. | 266/34 T |

*Primary Examiner*—Allen B. Curtis
*Assistant Examiner*—Thomas A. Waltz
*Attorney, Agent, or Firm*—Toren, McGeady and Stanger

[57] ABSTRACT

A method for reducing iron oxide in a melt of iron by maintaining a reduction layer on the surface of the molten iron and passing the molten metal from the melt through vertical channels which communicate at the bottom of the metal melt an with a space at the top of the melt which is above that of the reduction layer so as to pass the melt including the oxide there through the reduction layer, the molten metal being lifted up through the channel by means of a gas lift pump action and heating the molten metal by inductive heating while it is flowing through the channel.

2 Claims, 8 Drawing Figures

INDUCTIALLY HEATED GAS LIFT PUMP ACTION METHOD FOR MELT REDUCTION

Figure 1:
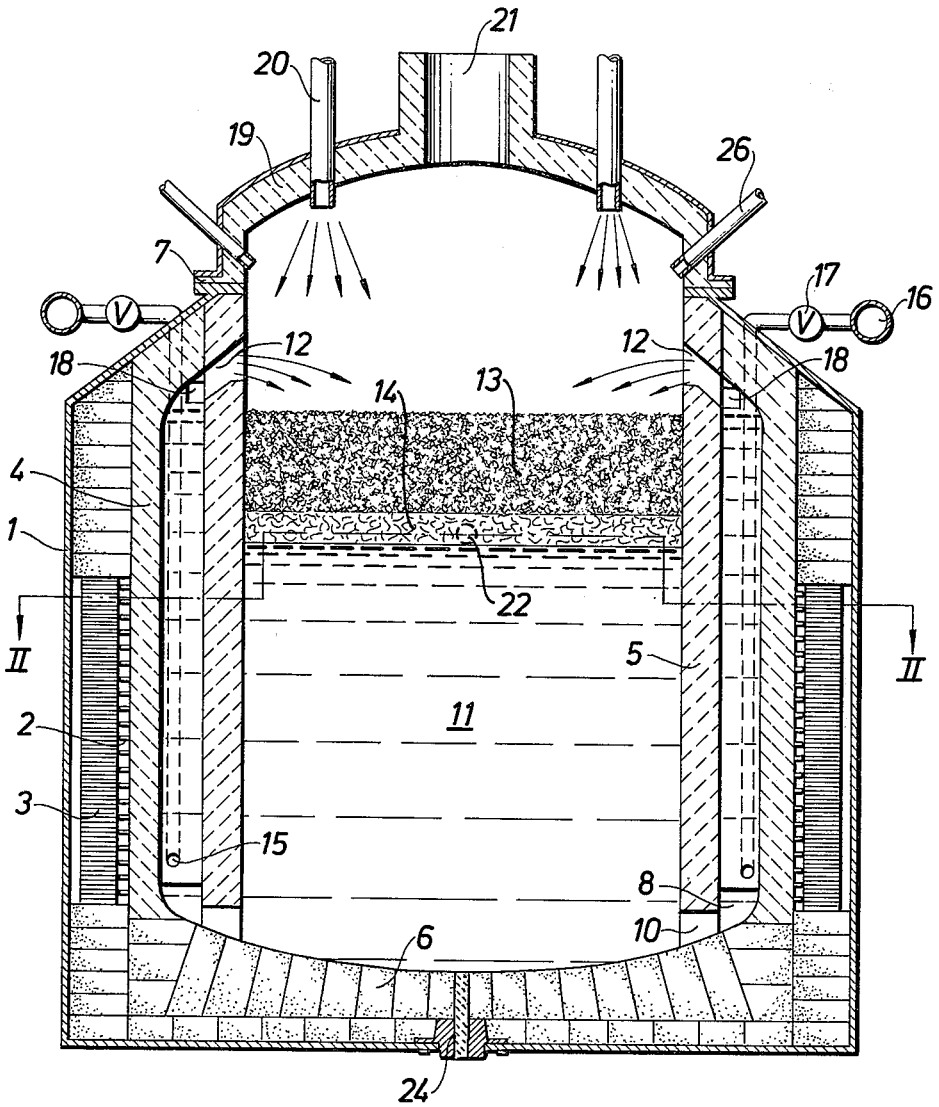

According to known methods, iron oxides can be reduced with carbon at a temperature exceeding the melting point of the raw iron obtained, so-called melt-reduction, by supplying finely powdered material rich in iron oxide, for example, iron ore concentrate, to a reaction layer resting on a melt of raw iron. The reaction layer consists of red-hot coke and possibly slag, the coke usually forming a layer on top of the floating layer of slag, which in turn rests on the raw iron melt. The reaction layer also contains reducing gases formed during the reaction between iron oxide and carbon. The reaction layer is kept supplied by the addition of coke or a solid fuel which will produce coke and may even be mixed with the material containing ferric oxide. Slagformer is also added when necessary so that the impurities, rock and ashes in the additives, form an easily floating slag.

The reduction of ferric oxides with carbon takes place in accordance with the reaction $FeO_x + X . C - FE + X . CO$, which is an endothermic reaction and consequently requires heat in the reaction layer. However, in the technical design of equipment for performing this method of melt reduction, it has been so difficult to arrange the supply of this heat that this type of reduction has had no commercial success in the manufacture of iron.

Extensive experiments have been performed, supplying the heat by combustion of carbon monoxide formed and the fuel added above the reaction layer, but this has resulted in unacceptably high costs for the refractory lining.

The heat requirement for the reduction process can also be provided by electricity which liberates heat in the coke layer, the slag or the iron melt. For high power it is advantageous to use induction furnaces to generate heat in the iron, but then the problem remains of how to transfer the heat to the coke layer. Since the heat transfer is made more difficult by the slag layer in between, the contents of the furnace must be mixed so vigorously that direct contact is created between the iron melt and the coke layer. This is difficult to accomplish with only inductive bath movement. Mixing is performed more efficiently by the supply or development of gas below the surface of the raw iron. However, not even this gives a completely satisfactory result.

The present invention relates to a method for melt-reducting a metal oxide, for example iron oxide, by introducing the material containing metal oxide to a reaction layer resting on a metal melt, preferably heated by induction to a temperature greater than the temperature of the reactor layer, while improving the heat transmission from the metal melt to the reaction layer. The invention also relates to a furnace for performing this method. The furnace is suitable for the production of raw iron by melt-reducing iron ore concentration or pre-reduced concentrate in a reaction layer resting on a layer of molten raw iron, but it can also be used for performing other processes where it is necessary for the heat to be supplied to a reaction layer from a metal melt.

According to the invention, molten metal is lifted from the metal melt to a level above the reaction layer and is then brought to run down through this. The molten metal thus emits heat to the reaction layer and is then re-united with the metal melt. The metal is preferably lifted in vertical channels which are in communication at the bottom with the molten bath and at the top with the space above the coke layer, this being effected by supplying a gas to the lower part of these vertical channels. An air lift pump action is thus produced. The inductive heating process is preferably performed in areas separated from the reaction layer and which may consist entirely or partially of the channels in which the metal is lifted by the gas flow. This prevents the slag in the reaction layer from coming into contact with the furnace wall between the induction winding and the metal melt, giving longer life to the lining.

The furnace and its function will be described in the following with reference to FIGS. 1 – 8.

Figure 2:
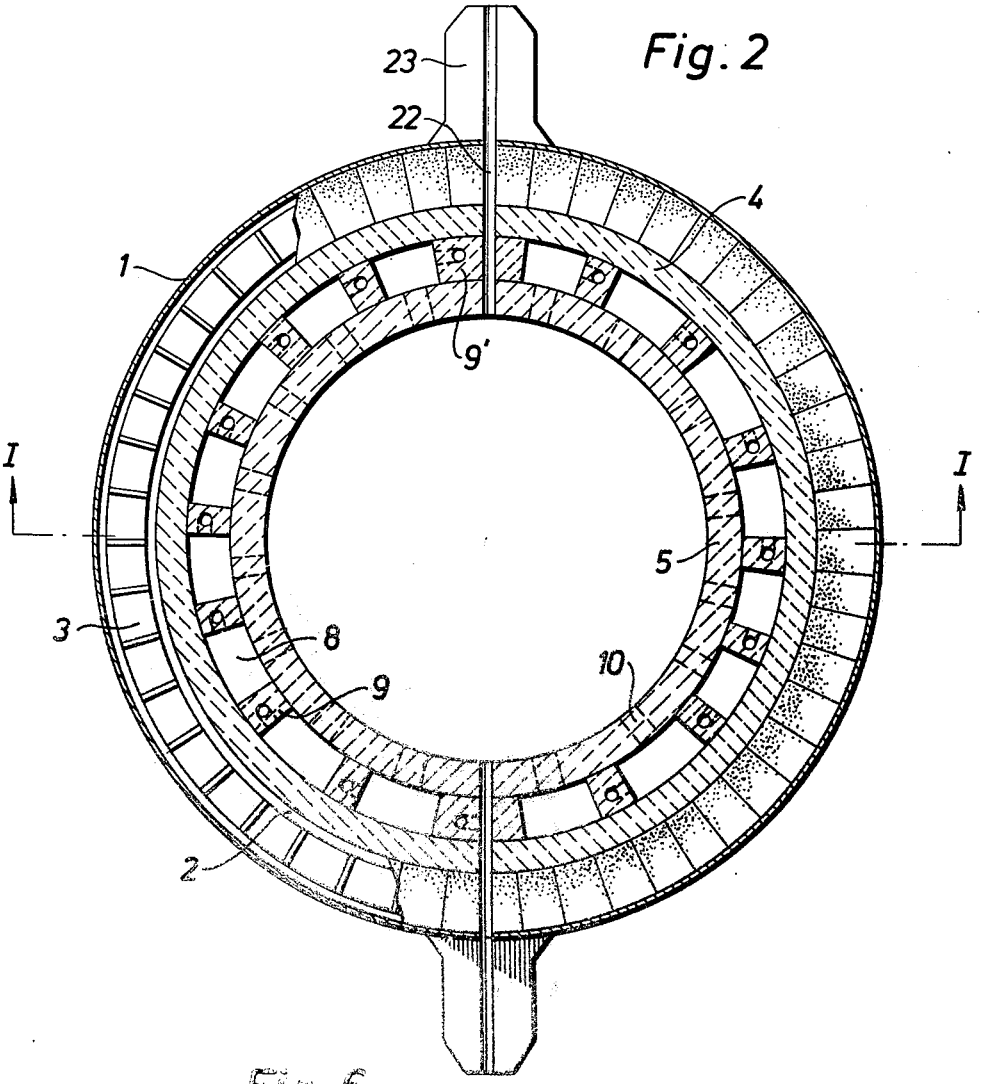
Figure 6:
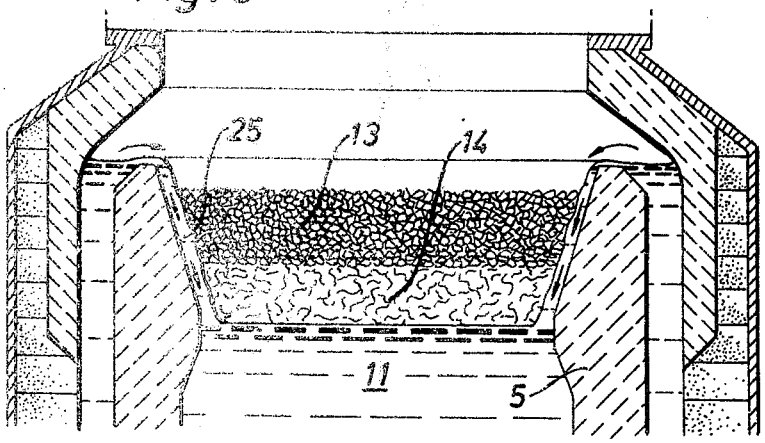
Figure 3:
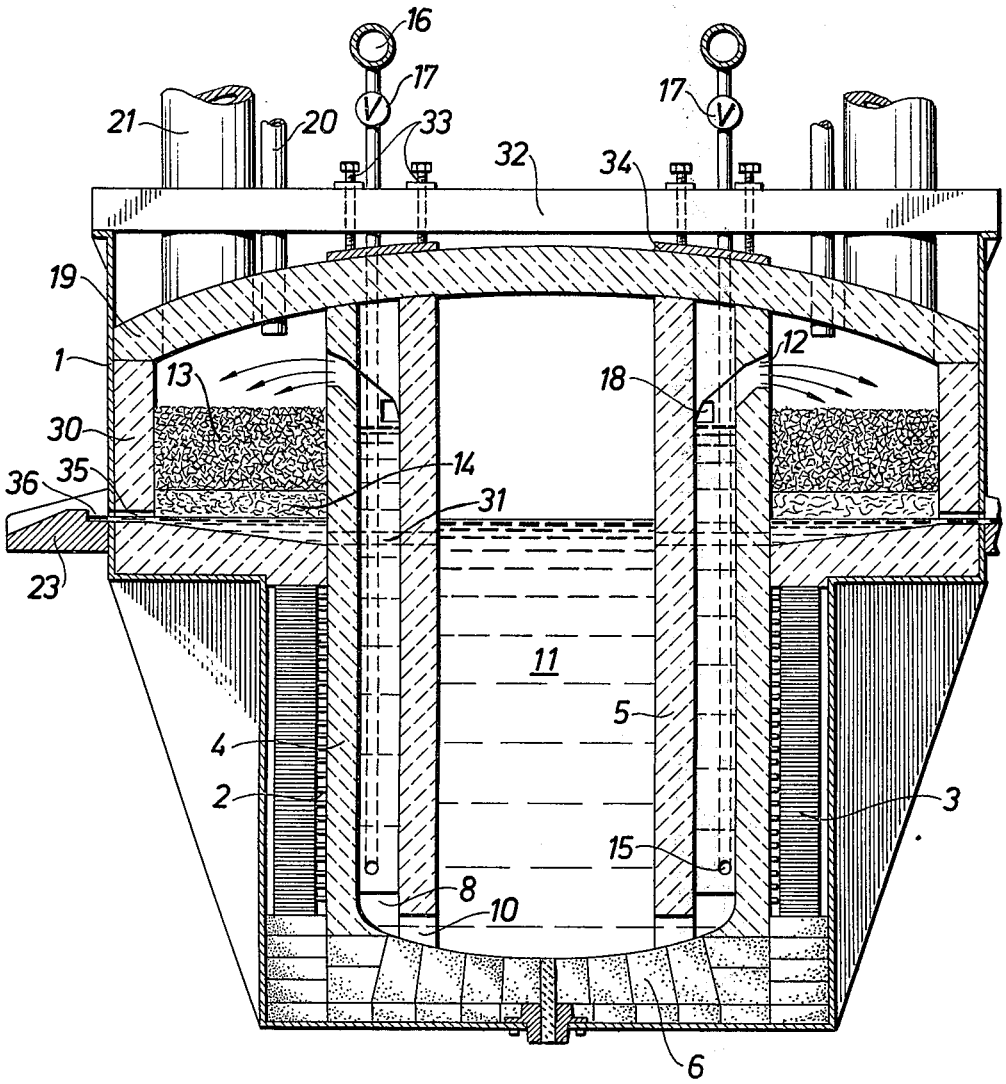
Figure 4:
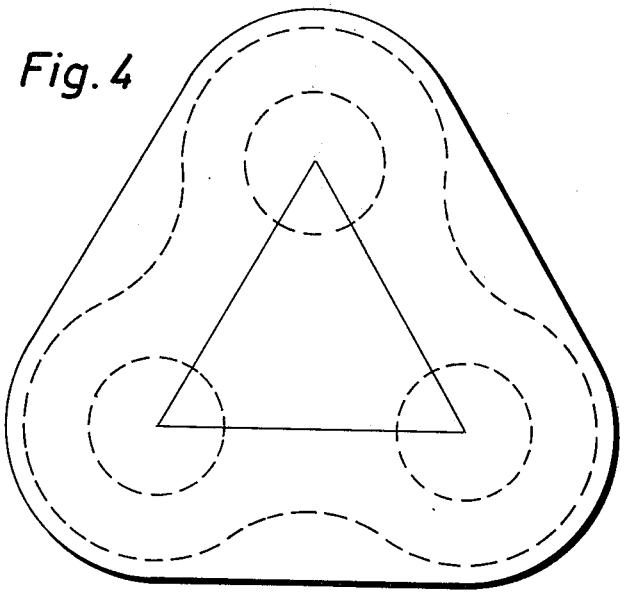
Figure 7:
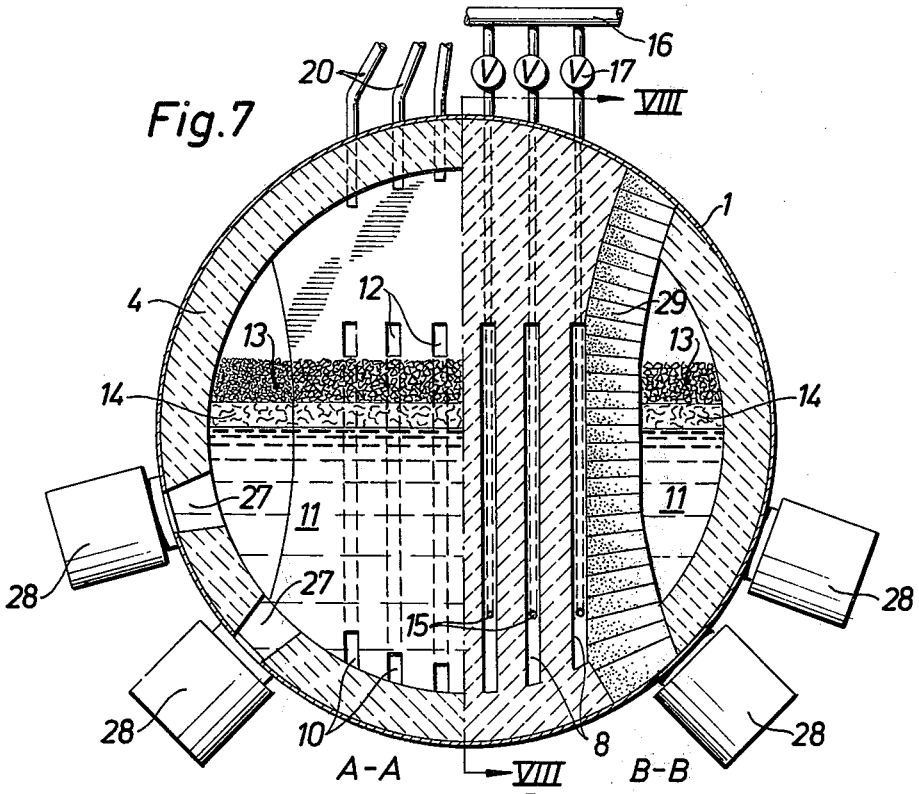
Figure 8:
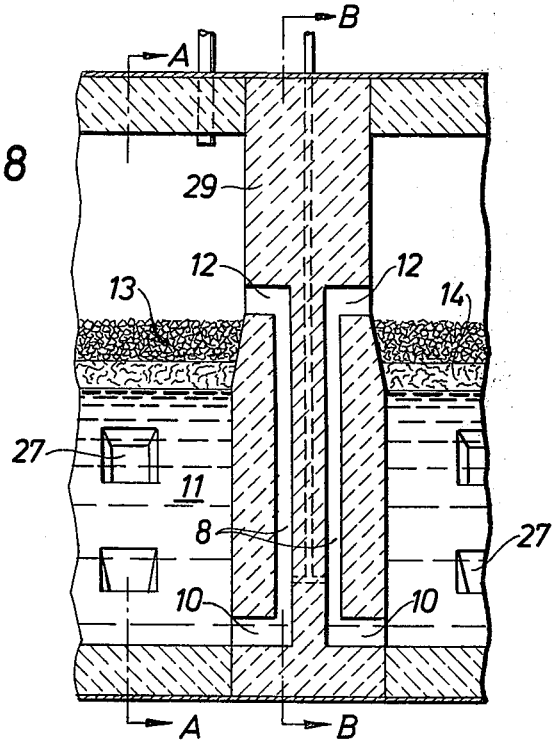

FIG. 1 shows a furnace in a vertical section and FIG. 2 a horizontal section of the same furnace through two planes indicated in FIG. 1. FIG. 3 shows a vertical section of a furnace according to an alternative embodiment with a larger area for the reaction layer. FIG. 4 shows a view from above and FIG. 5 a side view of an embodiment consisting of three furnaces in accordance with FIG. 3 which have been combined at the top. FIG. 6 shows one embodiment of the upper part of the brickwork. FIGS. 7 and 8 show the use of the invention in a furnace constructed as a horizontal cylinder.

The melting furnace according to FIGS. 1 and 2 consists of a sheet-metal casing 1, cylindrical and drawn in at the top, provided with a water-cooled induction loop 2 to heat the melt. The field of force of the loop is screened off from the sheet-metal casing by radially located stacks of sheet metal 3. The furnace is provided with a refractory lining 4 giving protection and insulation from the sheet-metal casing and the loop. Inside this lining is a walled cylinder 5 which rests on the bottom brickwork 6 of the furnace and the upper flange 7 of the sheet-metal casing. Between the cylinder and the furnace wall is a gap which is divided into a number of vertical channels 8 by means of columns of bricks 9, 9′, providing support in the radial direction for the cylinder 5. At the bottom of the cylinder are openings 10 leading to each channel so that the melt 11 inside the furnace and the channels can communicate. Openings 12 are also provided at the top of the cylinder, communicating between the channels and the inside of the furnace. These are sufficiently far above the surface of the molten metal to allow space for a reaction layer consisting of a coke layer 13 and a slag layer 14 between the iron bath and the lower edge of the openings.

Non-oxidizing gas, or liquid which vaporizes in heat (for example hydrocarbon) is supplied under pressure through ceramic or metal-ceramic tubes in the brick columns to the lower part 15 of the channels in such a quantity that the gas is able to lift the molten metal in the channels and spray it out through the openings 12 above the coke layer. Since fresh melt flows through the lower openings in the cylinder, the metal melt 11 is circulated and is heated inductively in the channels, to deliver the heat to the reaction layer 13, 14.

FIG. 6 shows a preferred embodiment of the upper part of the brickwork 5 designed to reduce slag corrosion on this brickwork. In this embodiment a layer of liquid metal 25 is obtained close to the brickwork so that the slag does not come into contact with the lining as long as circulation of the metal is in progress. It is advisable to direct the addition of ore and coke towards this layer of liquid metal. This results in rapid and intimate contact between the hot metal melt and the material added, thus accelerating the reaction.

The gas or gas-generating liquid is supplied through a tube 16 with connections to each inlet so that the flow in these can be adjusted by control valves 17 for each channel individually Openings 18 are provided at the top of the brick columns 9, 9' between adjacent channels. If the gas supply is cut off to one of the channels, the melt will flow through these openings from adjacent channels down so that the metal circulation is maintained in spite of a cut in the gas supply to one of the channels. If the gas supply to alternate channels is cut off and some of the lifted melt is permitted to flow down through these channels, the heating of the melt is increased but the quantity of melt sprayed out over the reaction layer decreases. The increased temperature of the melt compensates the decreased quantity and the same heat transmission is obtained with a smaller quantity of gas. The gas requirement can be further decreased by supplying gas only to every third channel. When making use of downflow in some of the channels, the supply of gas may be systematically and frequently directed from one channel to the next in order to achieve uniform load on all the channels and so that a successive cyclic displacement of the up-flow is obtained through every second or every third channel. Even further reduction of the metal flow and gas requirement can be achieved by intermittent gas supply to all the channels or intermittent gas supply to every second or every third channel with systematic displacement in accordance with the above. When a channel is not being used to lift the melt, however, sufficient gas flow should be maintained to prevent the melt from entering the inlet conduits for the gas or the gas-generating liquid.

The furnace is provided with a tightly fitting roof 19 with gastight lead-ins for one or more charging tubes 20 for raw products, reducing agent and slag-former, these being preferably distributed over the whole of the reaction layer. Gas produced during the reduction and gas for circulation of the melt is withdrawn through a gas conduit 21. It consists substantially of carbon monoxide and can with advantage be used as fuel in a steam power plant for the generation of electricity for the melting furnace.

In order to reduce the electricity requirement, some of the gas can be burnt with air above the coke bed, the air being supplied through one or more nozzles 26 in the upper part of the furnace. By directing the air flow towards the coke bed some of the coke can also be consumed. This is particularly valuable when, after prereduction of the concentrate with solid carbon, a pre-reduced product is sometimes obtained which is mixed with more coke than the quantity required for final reduction and the carburization of the melt. By regulating the air flow through the nozzles 26, it is possible to regulate the consumption of the carbon and thus burn off any coke excess in the charge.

Metal reduced in the coke layer releases carbon and forms metal drops which unite with the circulating metal melt. In order to keep the level of the bath in the furnace constant, a quantity of metal and slag is tapped off continuously, corresponding to the melting capacity of the furnace, through a tapping opening 22 leading through a widened brick column 9 between two channels above the induction loop 2. The bath level in the furnace by means of a dam arrangement in the channel 23 outside the furnace. Slag separation and further processing of the raw iron is performed according to known methods. So that the furnace can be emptied, for example for re-bricking, it is provided with a bottom opening 24 which is plugged with refractory mortar which can be removed from below.

FIG. 3 shows an alternative embodiment having a furnace casing 1 enlarged at the top. Around the upwardly extended crucible wall 4 is an annular hearth 30 in which the coke layer 13 and the slag layer 14 rest on a metal melt which communicates with the melt inside the cylinder 5 through an opening 31 arranged in the same way as the tapping opening 22 in FIG. 2. In accordance with this embodiment, the metal melt sprays out over the reaction layer through the opening 12 in the extended crucible wall. In order to secure the lining 4, cylinder 5 and brick columns 9, 9' in vertical direction, the tightly fitting roof 19 of the furnace is provided with a superstructure 32 having clamping screws 33 which are screwed into a support ring 34 resting on the roof of the furnace. To keep the level of the bath constant, metal and slag are tapped off continuously through a tapping aperture 35 to a channel 23 provided with a dam 36.

Figure 5:
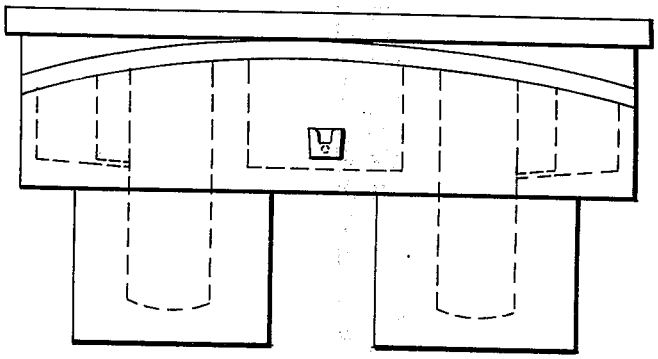

The furnace according to FIG. 3 is complicated in comparison with the furnace according to FIGS. 1 and 2 with the drawn in top, but it has the advantage that the area of the reaction layer can be increased in relation to both the power supplied and the contents of the furnace. In order to further increase the efficacy of the furnace, three induction furnaces of the type shown in FIG. 3 can be combined as shown in FIGS. 4 and 5, with a common hearth for the reaction layer. Each induction furnace can then be supplied with single-phase alternating current without causing uneven loading of the power supply.

In the embodiment shown in FIGS. 1 and 3, the cylinder 5 reaches right down to the bottom brickwork. This has the advantage that the circulating iron will be extremely free from slag, which increases the life of the brickwork 4, 5, 9. 9'. If an acceptable strength of the lining is obtained without this effective separation of the slag, however, it is possible within the scope of the invention to permit the cylinder and the brick columns with the gas outlets 15 reach just below the level of the metal melt. In this case the cylinder and the brick columns can be anchored in the upper part of the furnace.

Another way of enlarging the furnace volume is to construct the furnace as a horizontal cylinder. FIG. 7 shows two half vertical cross sections and FIG. 8 a part of a vertical longitudinal section through such a furnace. The furance comprises a horizontal, cylindrical sheet-metal casing 1 provided with a refractory lining 4. Openings 27 are provided in the lining and the casing, to which inductors 28 are connected. The melt 11 is heated in these channels.

Gas-driven circulation channels 8 are built in to partial partitions 29 suitably spaced from each other in the furnace. At the bottom of the partitions are openings 10 to each channel so that the melt 11 in the furnace communicates with the channels. Openings 12 are also provided in the upper part of the cylinder between the channels and the furnace chamber. These are sufficiently far above the surface of the molten metal to allow place for the reaction layer consisting of a layer of coke 13 and a layer of slag 14 between the iron bath and the lower edge of the openings.

Non-oxidizing gas, for example nitrogen, or liquid which vaporizes in heat, for example hydrocarbon, is supplied under pressure through apertures 15 in the lower part of the channels in such quantities that the gas is able to lift the melt in the channels and spray it out through the openings 12 above the layer of coke. The gas or liquid is supplied through a tube 16 with regulating valves 17 for each inlet.

The furnace is also provided with charging tubes 20 for raw material as well as inlets, not shown, for any combustion air used and outlets for exhaust produced.

Since the partitions 29 are only partial, equalization occurs in the longitudinal direction of the furnace and slag and metal melt produced can be tapped off at the end of the furnace. The furnace is made pivotable so that the inductors can be replaced without the furnace having to be emptied.

What is claimed is:

1. In a method for reducing a metal oxide by introducing a material rich in metal oxide to a reaction layer resting on a metal melt, the improvement which comprises lifting molten metal from the metal melt to a level above that of the reaction layer through vertical channels which communicate at the bottom with the metal melt and at the top with a space at a level above that of the reaction layer by supplying a non-oxidizing gas to the lower part of the channels so that the molten metal is lifted up through the channel by means of the gas lift pump action, heating said molten metal inductively to a temperature greater than the temperature of the reaction layer while it is flowing through the channels to supply additional heat to the reaction layer and then allowing the thus lifted heated molten metal to exit from the top of the channels and pass down through said reaction layer and return to the metal melt.

2. The method of claim 1, wherein the molten metal is heated inductively in the lower portion of said channels thereby aiding the upward motion of the molten metal through said channels.

* * * * *